US010791804B2

(12) United States Patent
Chu

(10) Patent No.: US 10,791,804 B2
(45) Date of Patent: Oct. 6, 2020

(54) AUTOMATIC MAGNETIC BUCKLE AND ITS USE METHOD

(71) Applicant: Fang Meng Chu, Guang Dong Province (CN)

(72) Inventor: Fang Meng Chu, Guang Dong Province (CN)

( * ) Notice: Subject to any disclaimer, the term of this patent is extended or adjusted under 35 U.S.C. 154(b) by 90 days.

(21) Appl. No.: 16/116,913

(22) Filed: Aug. 30, 2018

(65) Prior Publication Data

US 2020/0069003 A1 Mar. 5, 2020

(51) Int. Cl.
*A44B 11/26* (2006.01)

(52) U.S. Cl.
CPC ..... *A44B 11/266* (2013.01); *A44D 2203/00* (2013.01)

(58) Field of Classification Search
CPC ..... A44B 11/2519; A44B 11/2573; A44B 11/266; Y10T 24/45084; Y10T 24/45094; Y10T 24/32; A44D 2203/00
See application file for complete search history.

(56) References Cited

U.S. PATENT DOCUMENTS 3,041,697 A * 7/1962 Budreck ..... A44B 15/002 24/303
9,101,185 B1 * 8/2015 Greenberg ..... A44C 5/20

* cited by examiner

*Primary Examiner* — Robert Sandy

(57) ABSTRACT

The present invention discloses an automatic magnetic buckle, which comprises a matching clamping head and a buckle base. The said clamping head comprises a clamping head housing, and the said clamping head housing has a cavity extending through the upper and lower ends of the clamping head housing. The said cavity is set with a buckle subassembly, the said buckle base is set with a clamping head matching with the said buckle subassembly, and the said clamping head and the buckle base are set with magnetic subassemblies which are mutually attracted. Clamping head and buckle base are attracted together through the matching of the magnetic subassembly. The buckle subassembly is matched with the clamping head to securely connect the clamping head and the buckle base. The present invention also discloses a method of using the automatic magnetic buckle.

10 Claims, 15 Drawing Sheets

AUTOMATIC MAGNETIC BUCKLE AND ITS USE METHOD

BACKGROUND OF THE INVENTION

The present invention relates to a buckle structure and in particular to an automatic magnetic buckle and the method of using the automatic magnetic buckle.

The current buckle is magnetically connected by adding a magnetic subassembly. Due to the unreasonable structure design of the existing buckle, the connection between the buckle base and the clamping head is not firm enough. However, the existing buckle is designed in a flat shape, and it can be fastened and separated by two hands and at a single angle and is used inconveniently. The existing buckle and the buckle base cannot rotate 360°. Therefore, the buckle base and the clamping buckle cannot be connected and disconnected.

BRIEF SUMMARY OF THE INVENTION

In order to solve the above problems, the present invention discloses an automatic magnetic buckle.

The present invention further discloses a method of using the automatic magnetic buckle.

In order to achieve the above objective, the technical solution adopted by the present invention is:

An automatic magnetic buckle comprises a matching clamping head and a buckle base. The said clamping head comprises a clamping head housing, and the said clamping head housing has a cavity extending through the upper and lower ends of the clamping head housing. The said cavity is set with a buckle subassembly, and the said buckle base is set with a buckle head matching with the said buckle subassembly, and the said clamping head and the buckle base are set with magnetic subassemblies which are mutually attracted. Clamping head and buckle base are attracted together through the matching of the magnetic subassembly. The buckle subassembly is matched with the buckle head to securely connect the clamping head and the buckle base.

The said buckle subassembly comprises a left fastener and a right fastener which are symmetrically set in the cavity and have the same structure. The middle parts of the said left fastener and right fastener are hinged asway in the cavity. A pressure spring is connected between the upper inner sides of the left fastener and the right fastener, and the lower ends of the left fastener and the right fastener are oppositely set with a clamping block matching with the said buckle head. A fastener unfolding device is connected to the upper ends of the left fastener and the right fastener. An acting force is applied to the fastener unfolding device to make the upper parts of the left fastener and the right fastener swing toward each other. The distance between the lower parts of the left fastener and the right fastener is increased, and the buckle head is not covered by the clamping block. An acting force is applied to the clamping head and the buckle base. When the acting force is greater than the magnetic attraction force between the magnetic subassemblies, the buckle head and the buckle base can be separated.

The magnetic subassembly of the said clamping head is set at a lower end of the said cavity, and the lower part of the said buckle subassembly is located at the magnetic subassembly of the clamping head. The magnetic subassembly of the said buckle base is set in the said buckle base, and the magnetic subassembly of the said buckle base is located under the said buckle head. When the magnetic subassemblies of the clamping head and the buckle base are mutually attracted, the buckle head can be automatically inserted between the two clamping blocks. A pressure spring is connected between the upper inner sides of the left fastener and the right fastener to make the two clamping blocks tighten the buckle head.

The said clamping head housing includes a front housing and a rear housing, and the opposite walls of the front housing and the rear housing are respectively set with a half recess forming the said cavity.

A metal piece is further fixed between the upper ends of the front housing and the rear housing, and the upper end of the metal piece is set with a pull ring stretching out the top of the front housing and the rear housing. During use, the belt and the clamping head housing can be connected when the belt passes through the pull ring and is tightened.

The said automatic magnetic buckle, according to claim 2, is characterized in that the said fastener unfolding device is a rope, and the two ends of the said rope are respectively fixed with the upper ends of the left fastener and the right fastener. The middle part of the rope passes through the clamping head housing from the top of the said cavity. When the buckle base is separated from the clamping head, the rope shall be pulled to make the upper ends of the left fastener and the right fastener swing toward each other. The distance between the clamping blocks is increased, and the buckle head can be pulled out.

The said fastener unfolding device has two pressing members, and the said pressing members include a pressing rod and a pressing head which are interconnected. The pressing rods of the two pressing members are respectively in contact with the outer sides of the left fastener and the right fastener, and the said pressing head stretches out the outer periphery of the clamping head housing.

The said clamping block is laterally set, and the end of the buckle block is set with a triangular or semi-circular notch. The said buckle head is a mushroom-shaped protrusion matching with the said clamping block. The mushroom-shaped protrusion is like a mushroom and comprises a lower cylinder and an upper clamping body. The diameter of the clamping body is greater than the diameter of the cylinder. The said two clamping blocks are clamped on the cylinder, and the two clamping blocks are located under the clamping body.

The said buckle base has a plate shape, and the two ends of the buckle base are respectively set with long-striped webbing slots. The two long-striped slots are respectively set in parallel. During use, another belt passes through the two long-striped webbing slots to firmly and stably connect the buckle base and the belt.

The buckle base has a rectangular groove shape, the bottom of the buckle base is set with a rectangular groove-shaped webbing slot, and the long-striped webbing slot is set in parallel. During use, another belt passes through the two long-striped webbing slots to firmly and stably connect the buckle base and the belt.

The upper surface of the buckle base is set with a circular groove, the inner diameter of the said circular groove is greater than the outer peripheral diameter of the clamping head housing, and the buckle head is located in the middle of the said circular groove. The circular groove can prevent the joint between the clamping head and the buckle base from being impacted by an external force and make the connection firm and stable.

The said buckle base is cylindrical, the lower part of the buckle base is set with a metal piece, and the metal piece is set with a long-striped webbing slot.

The upper surface of the buckle base is set with a circular groove, the inner diameter of the said circular groove is greater than the outer peripheral diameter of the clamping head housing, and the buckle head is located in the middle of the said circular groove.

The opposite walls of the front housing and the rear housing are set with matching positioning columns and positioning holes, and the front housing and the rear housing are matched and connected with screws and nuts. Thus, the connection between the front housing and the rear housing is firm and stable without misplacement.

A method of using an automatic magnetic buckle includes the following steps:

Step 1: The buckle base is close to the clamping head, and the buckle base is mutually attracted with the magnetic subassembly on the clamping head. Under the action of the magnetic attraction force, the buckle head is inserted into the cavity of the clamping head housing, the buckle subassembly is used to fix the buckle head, and the clamping head is fixedly connected with the buckle base.

Step 2: An acting force is applied to the left fastener and the right fastener via the fastener unfolding device to make the upper ends of the left fastener and the right fastener swing toward each other. The distance between the two clamping blocks is increased, and the clamping head can be removed from the buckle head to separate the clamping head and the buckle base.

The present invention has the following advantageous effects: The structural design of the present invention is reasonable and ingenious. The fixed connection between the buckle base and the clamping head can be easily realized by the action of the magnetic subassembly, and the connection is stable and firm. The buckle base and the clamping head can be conveniently separated by the design of the fastener unfolding device. Moreover, the buckle base and the clamping head can rotate at 360°, so the buckle base and the clamping head can be buckled or separated at any angle. It can be operated conveniently and saves time and effort.

The present invention is further described below through the figures and specific embodiments.

DETAILED DESCRIPTION OF THE INVENTION

Refer to FIG. 1 to FIG. 6 and FIG. 9 for Embodiment 1. An automatic magnetic buckle provided by the present embodiment comprises a matching clamping head 1 and a buckle base 2. The said clamping head 1 comprises a clamping head housing, and the said clamping head housing has a cavity extending through the upper and lower ends of the clamping head housing. The said cavity is set with a buckle subassembly, and the said buckle base 2 is set with a buckle head 21 matching with the said buckle subassembly, and the said clamping head 1 and the buckle base 2 are set with magnetic subassemblies which are mutually attracted. Clamping head 1 and buckle base 2 are attracted together through the matching of the magnetic subassembly. The buckle subassembly is matched with the buckle head 21 to securely connect the clamping head 1 and the buckle base 2.

Figure 1:
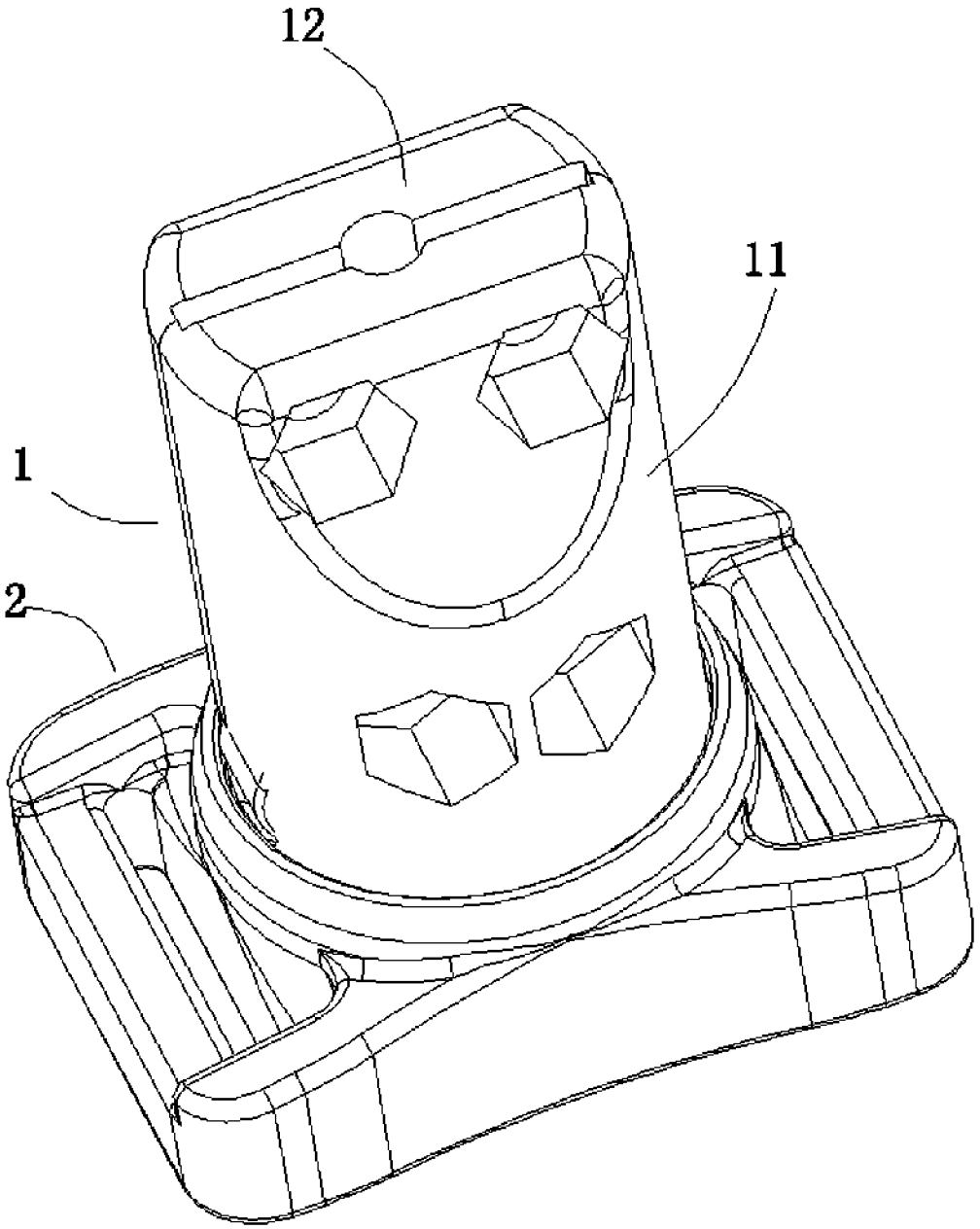
FIG. 1 is a perspective view for Embodiment 1 of the present invention.
Figure 2:
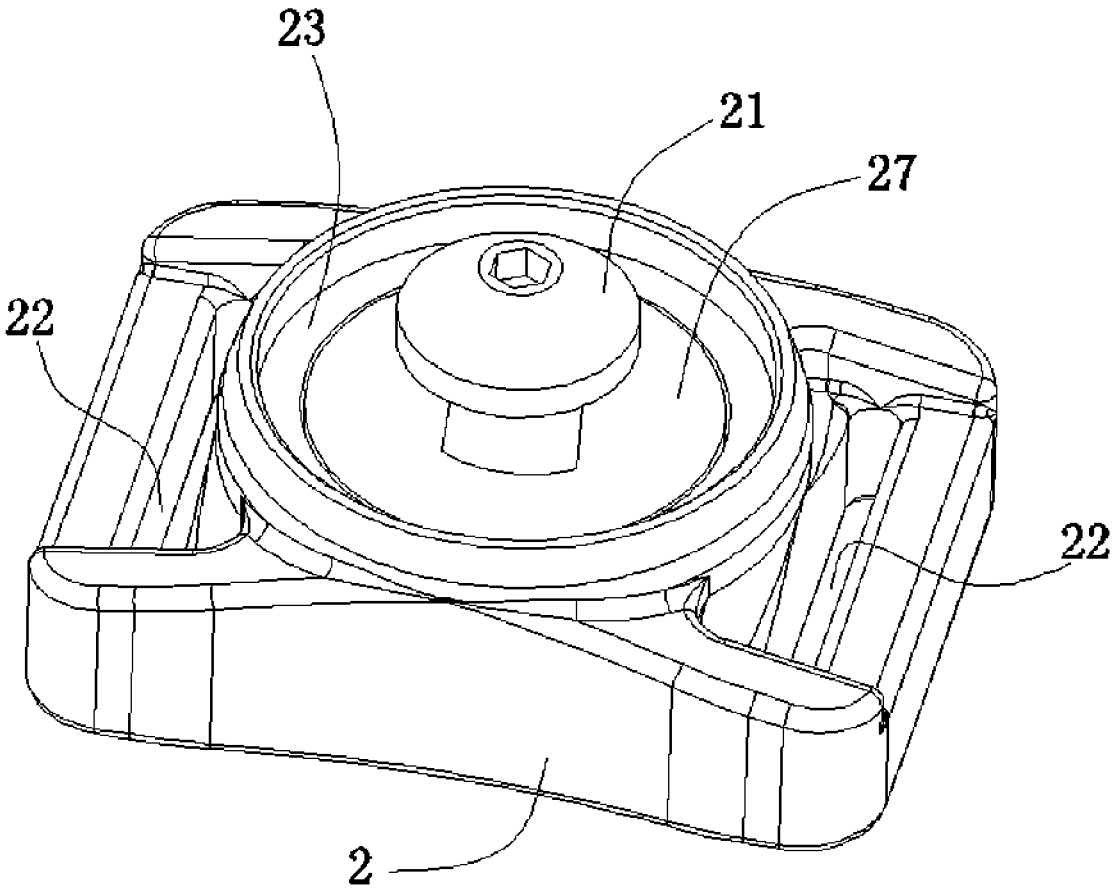
FIG. 2 is a structure view for the buckle base of FIG. 1.
Figure 3:
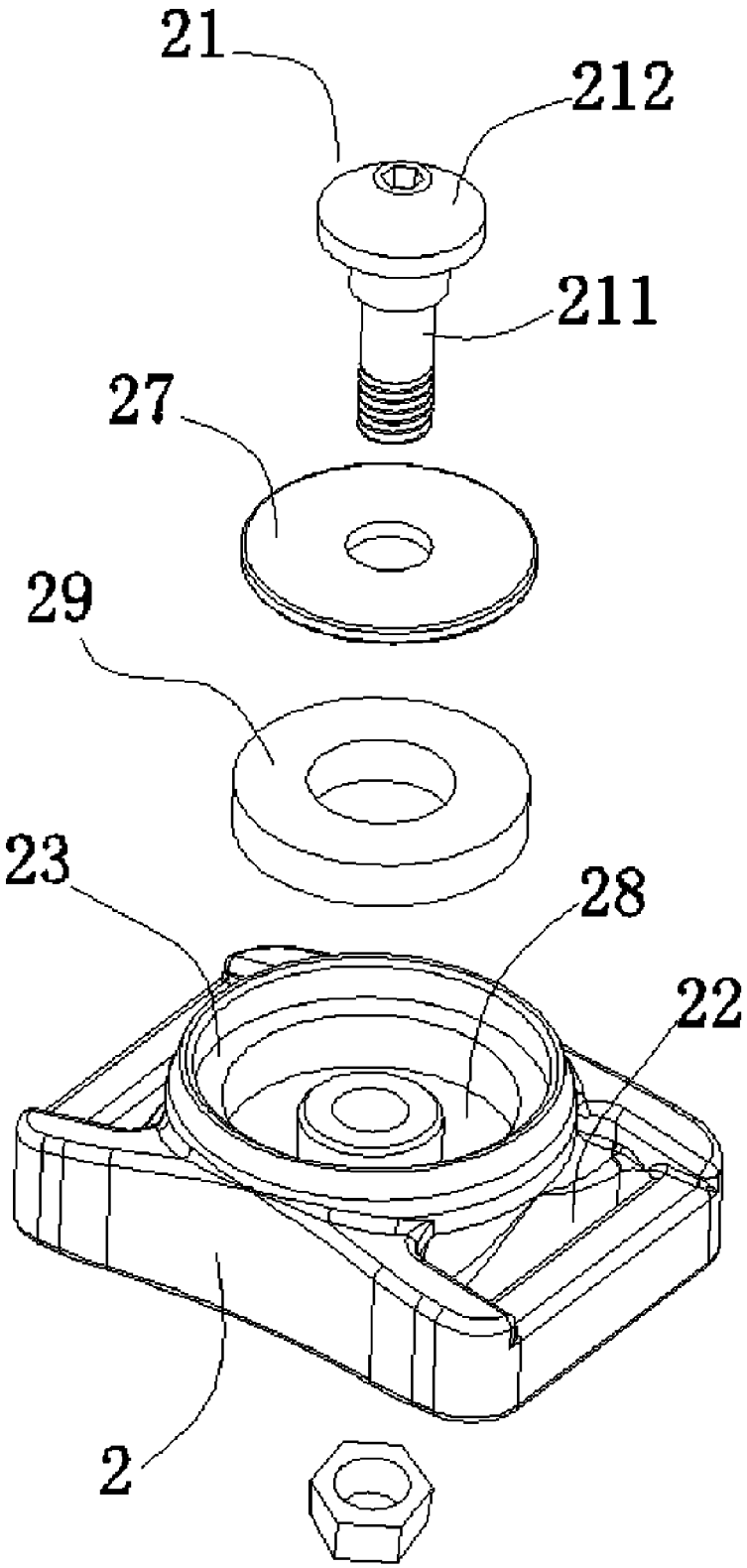
FIG. 3 is a breakdown view for FIG. 2.
Figure 4:
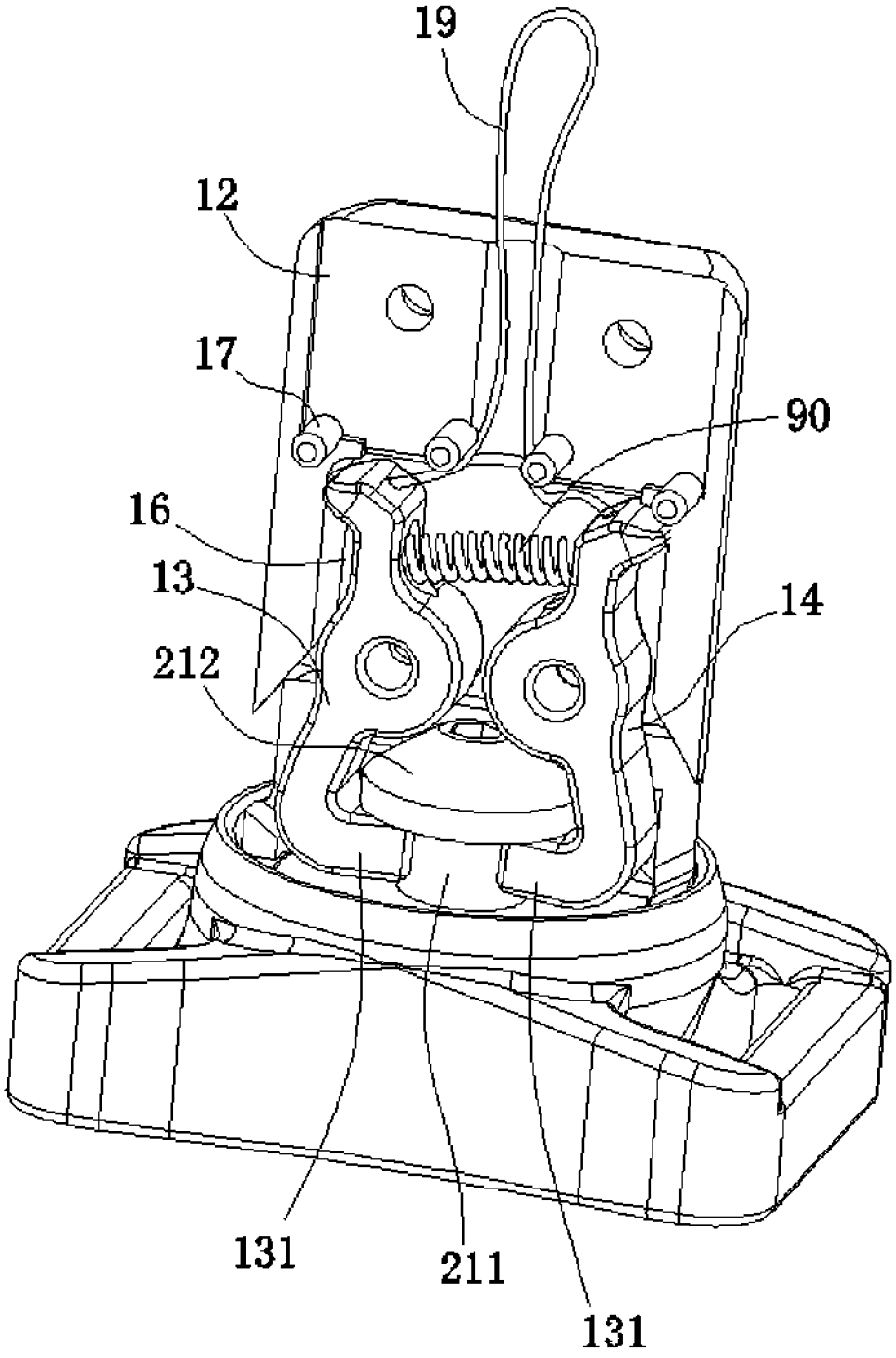
FIG. 4 is an assembly diagram for the buckle base and the clamping head of FIG. 1.
Figure 5:
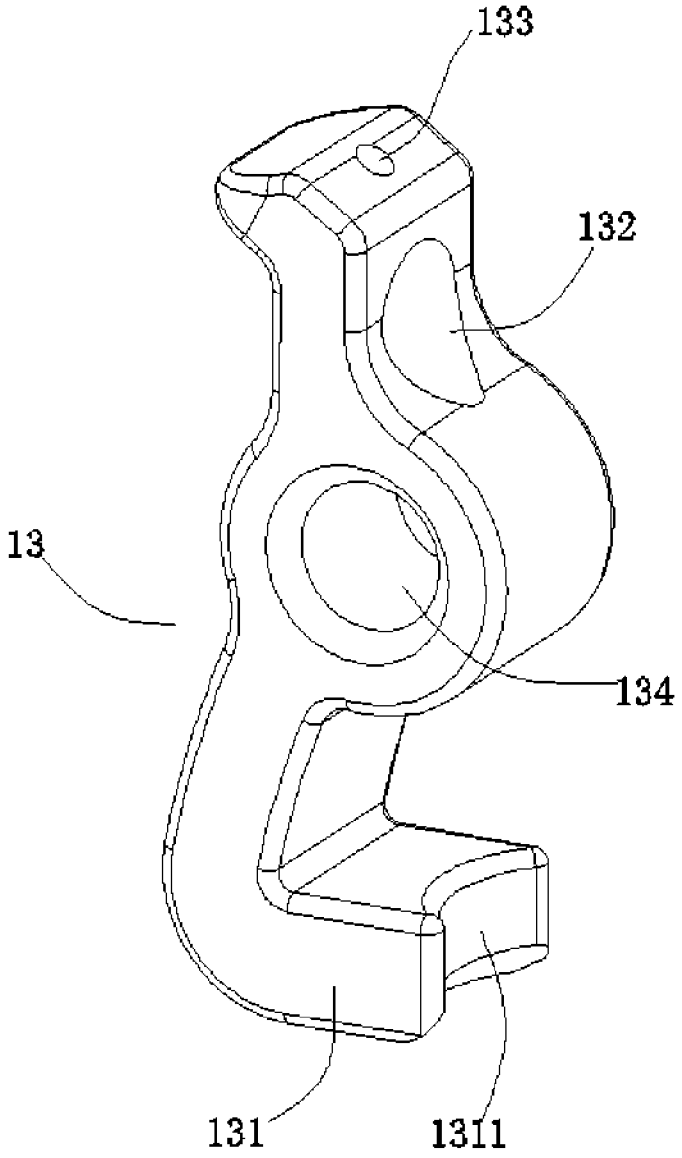
FIG. 5 is a structure view for the left fastener of the present invention.
Figure 6:
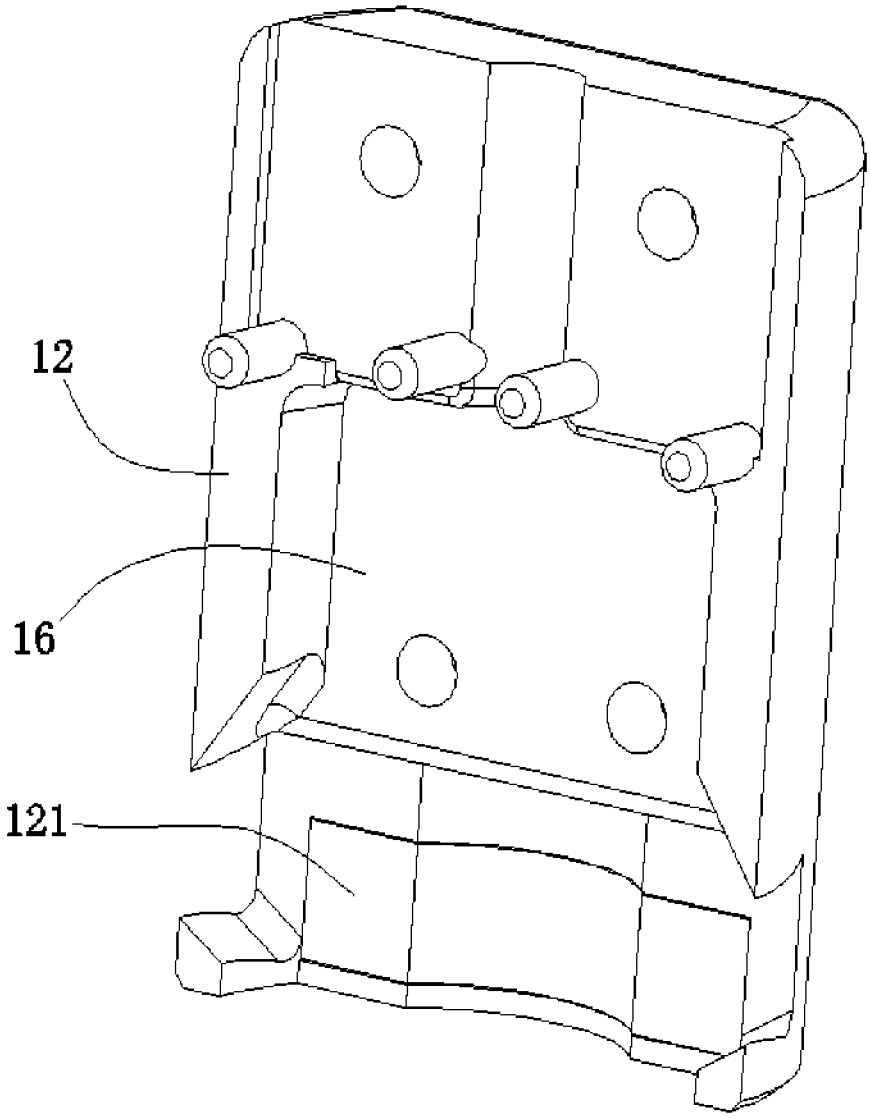
FIG. 6 is a structure view for a rear housing of the present invention.
Figure 7:
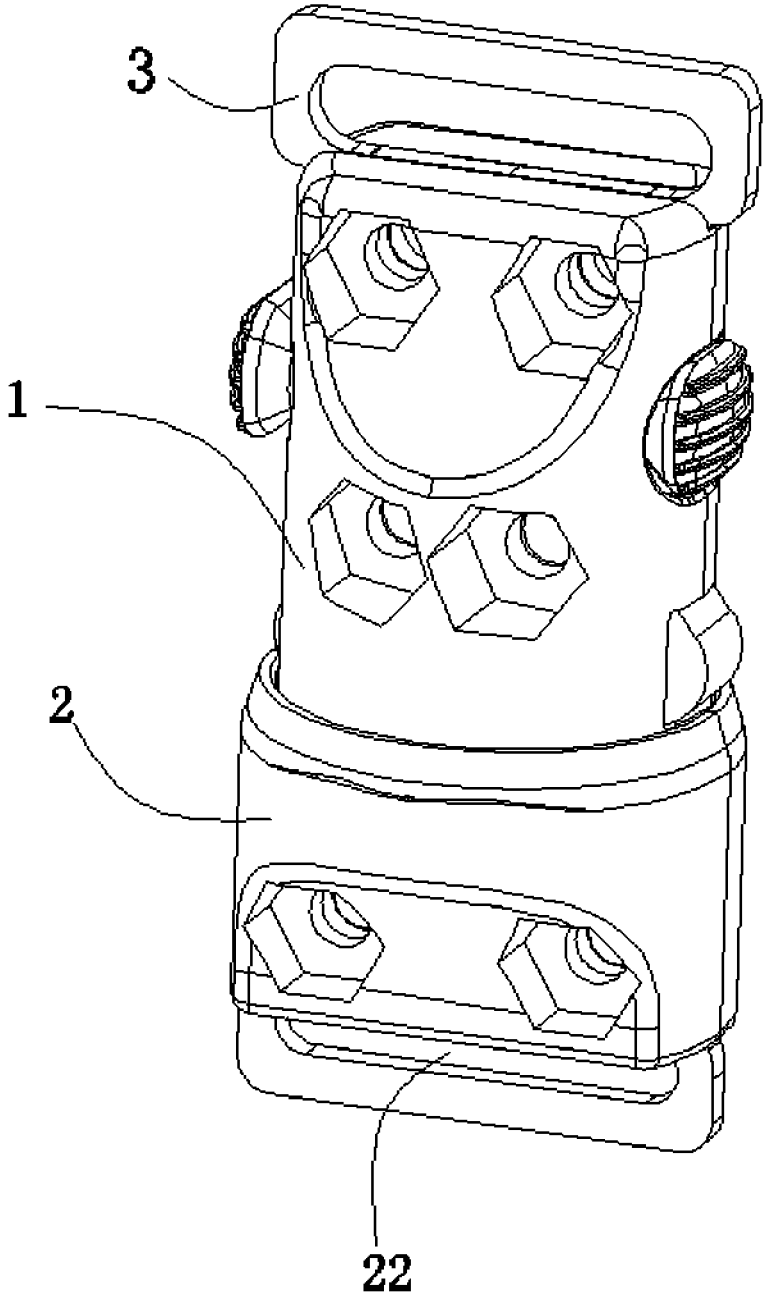
FIG. 7 is a perspective view for Embodiment 2 of the present invention.
Figure 8:
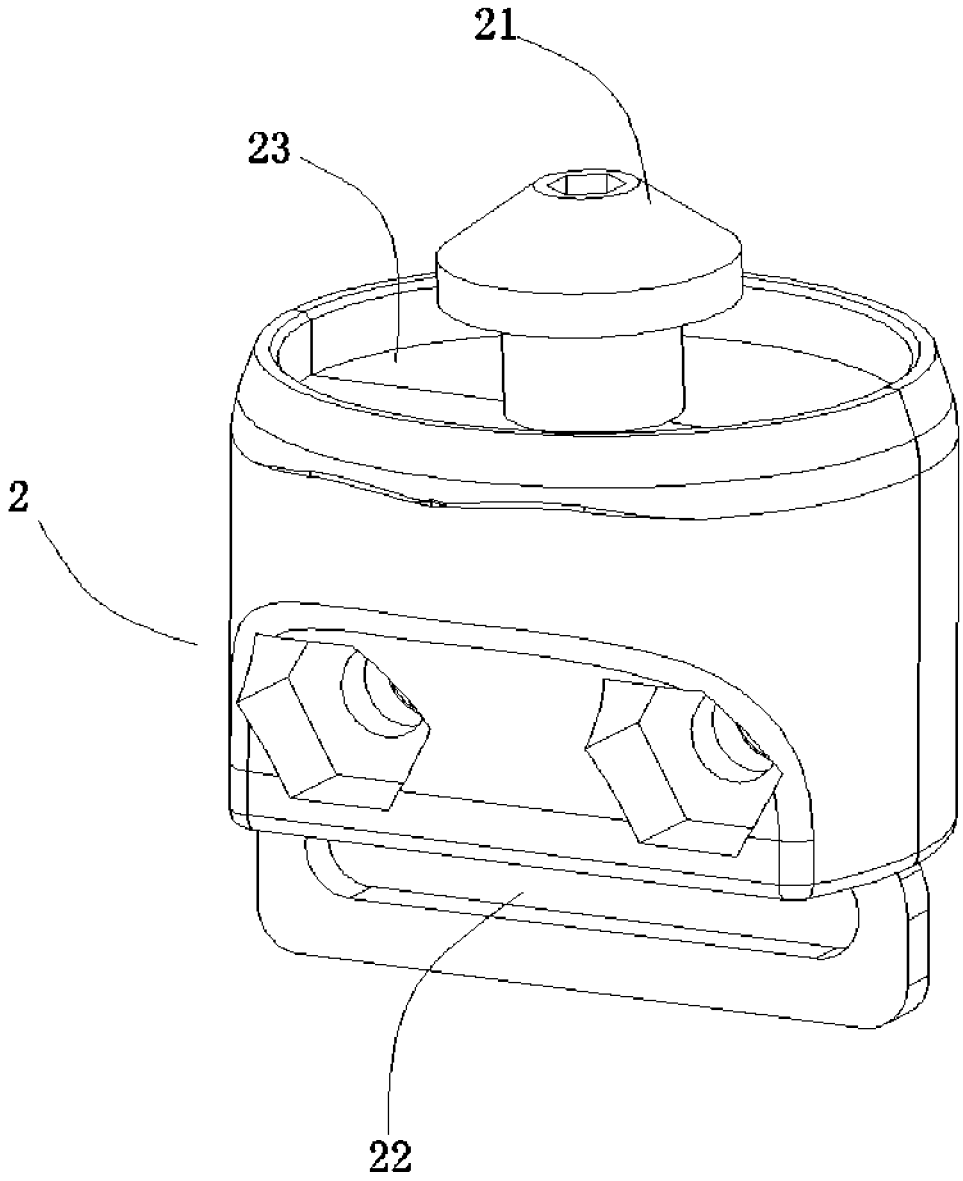
FIG. 8 is a structure view for the buckle base in FIG. 7.
Figure 9:
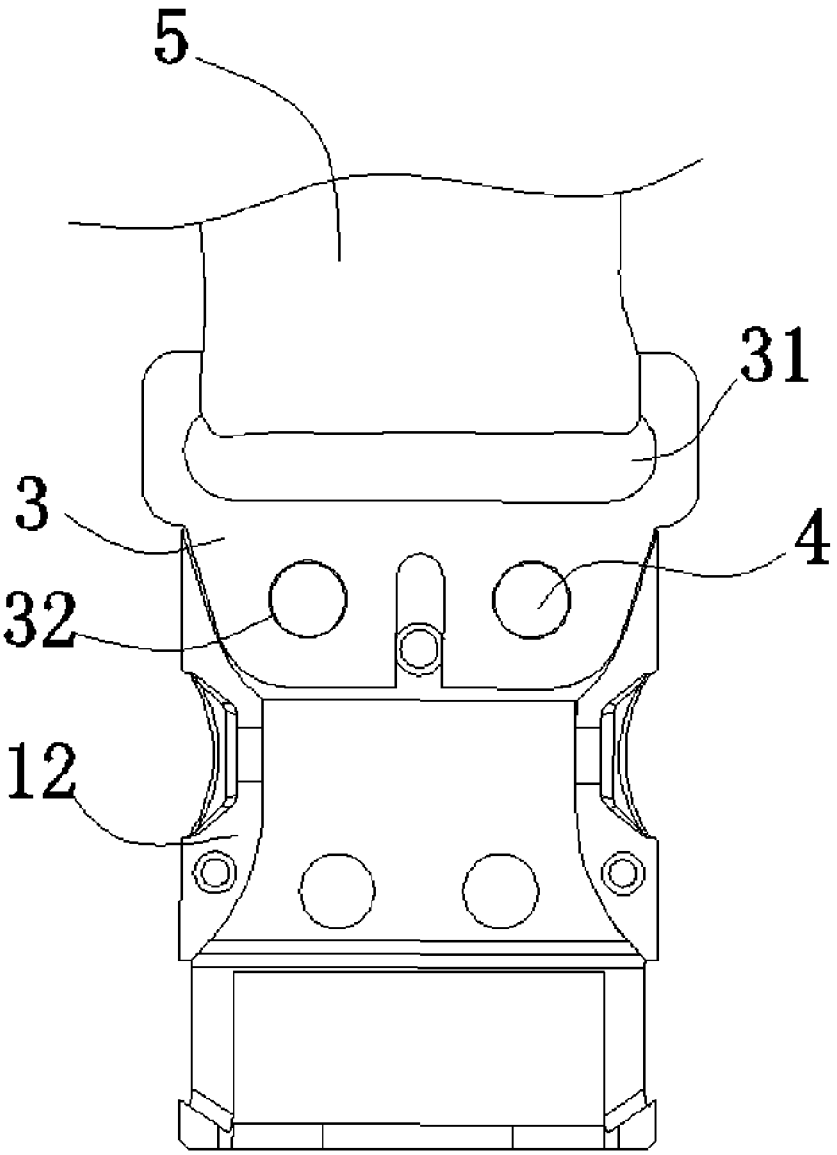
FIG. 9 is an assembly diagram for the metal piece and the rear housing in the present invention.
Figure 10:
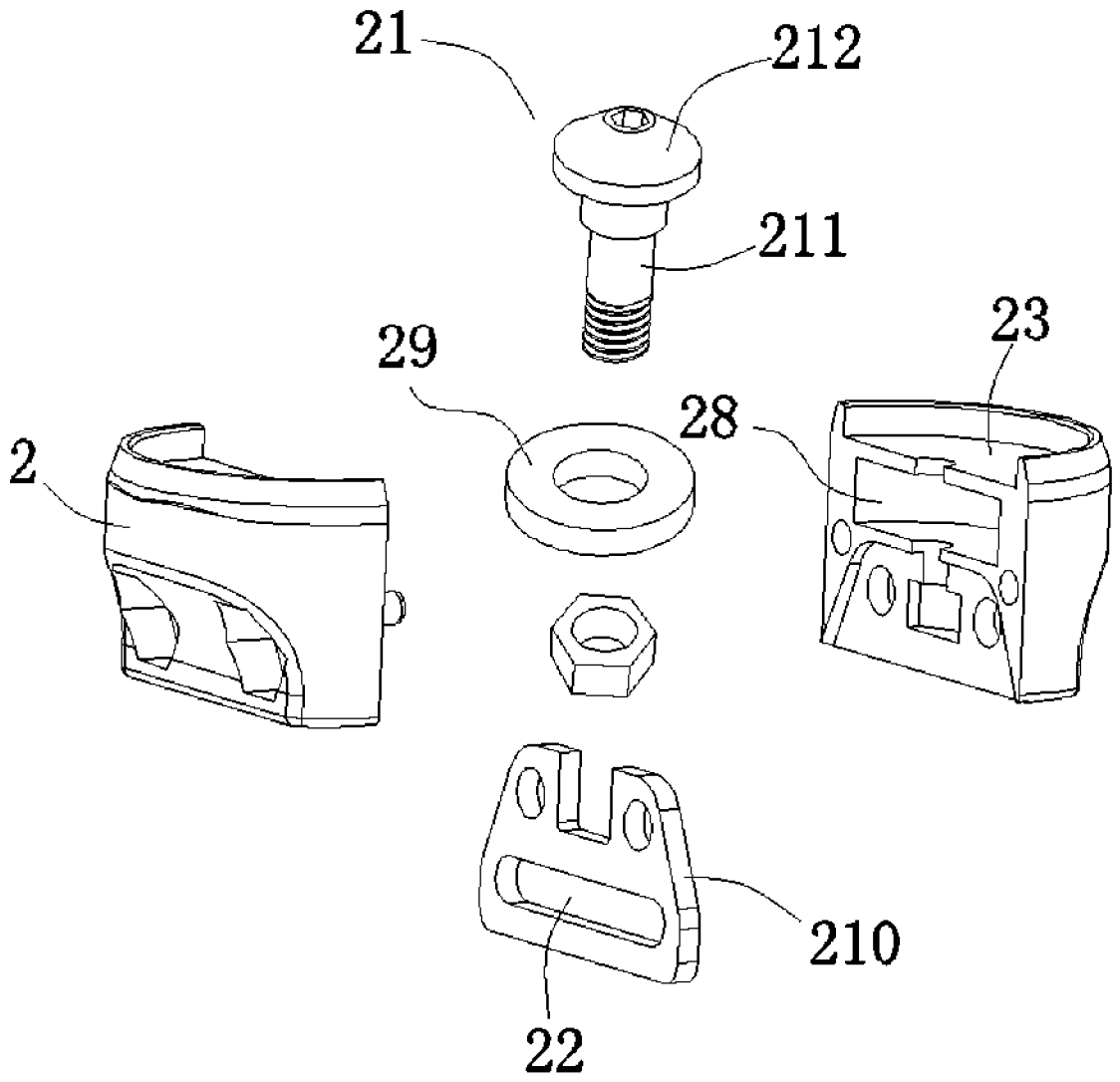
FIG. 10 is a breakdown view for FIG. 8.
Figure 11:
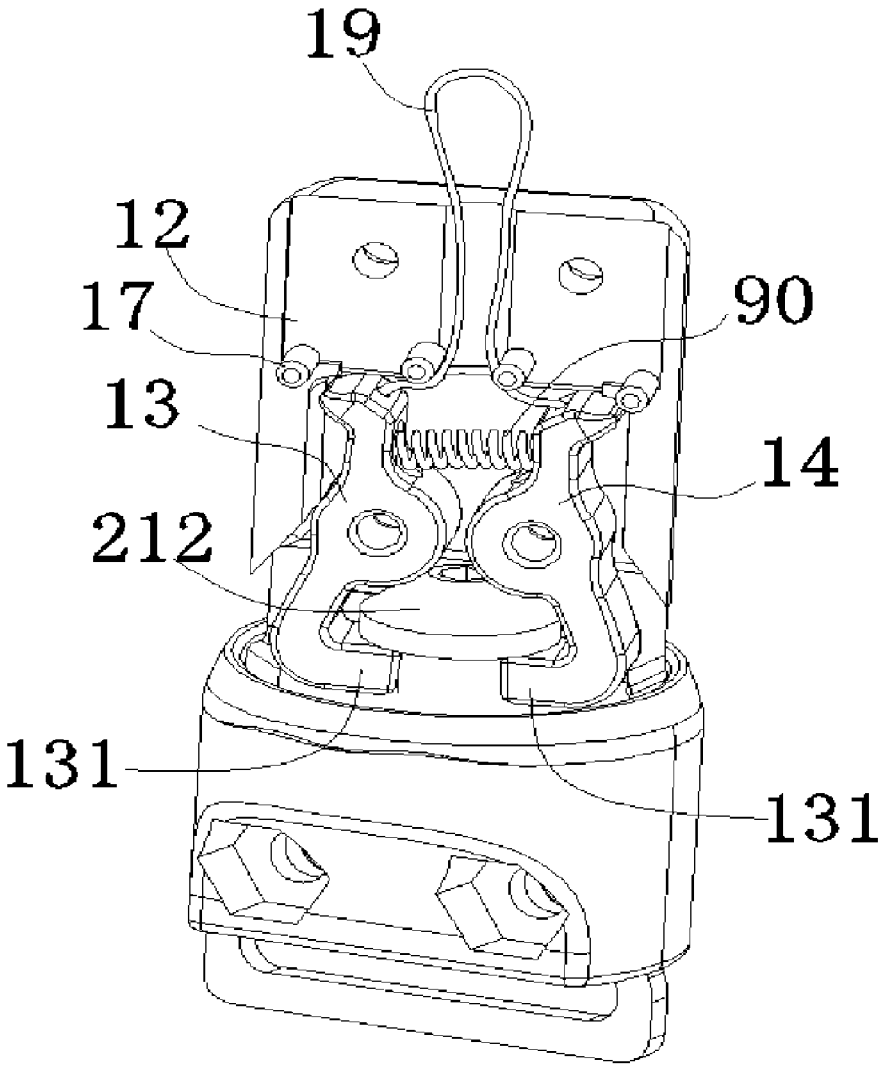
FIG. 11 is an assembly diagram for the buckle base and the clamping head in FIG. 7.
Figure 12:
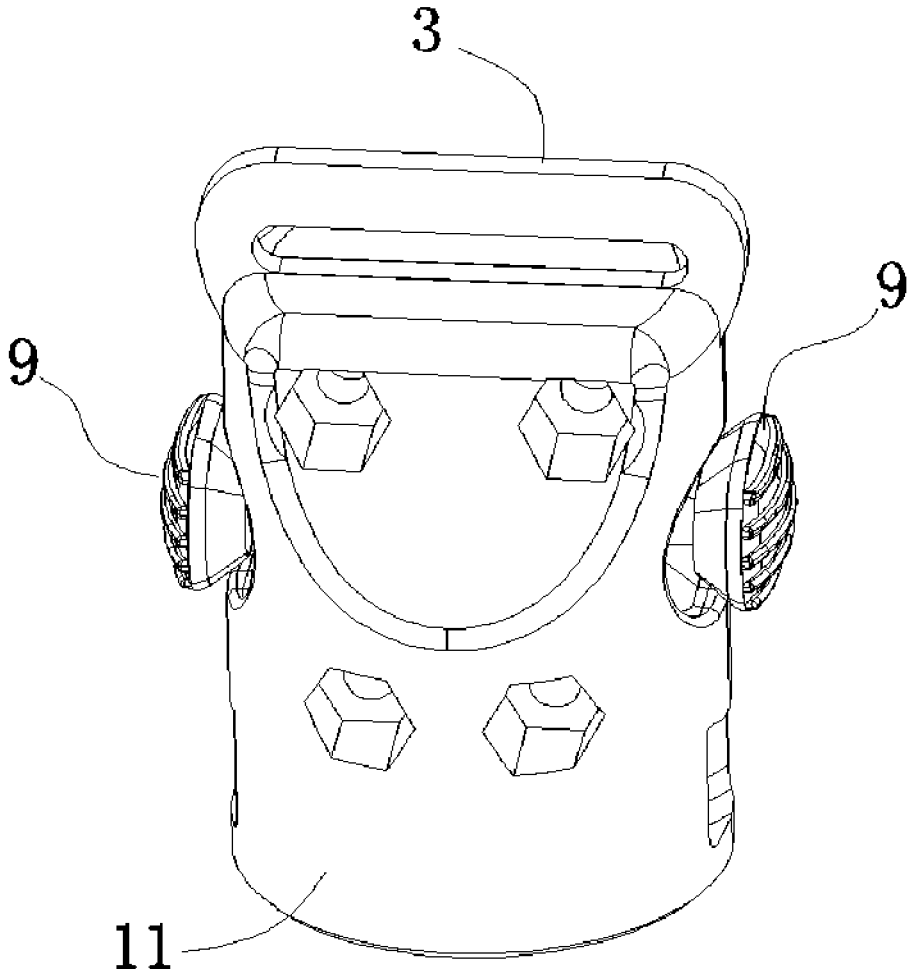
FIG. 12 is a perspective view for a clamping head in Embodiment 3 of the present invention.
Figure 13:
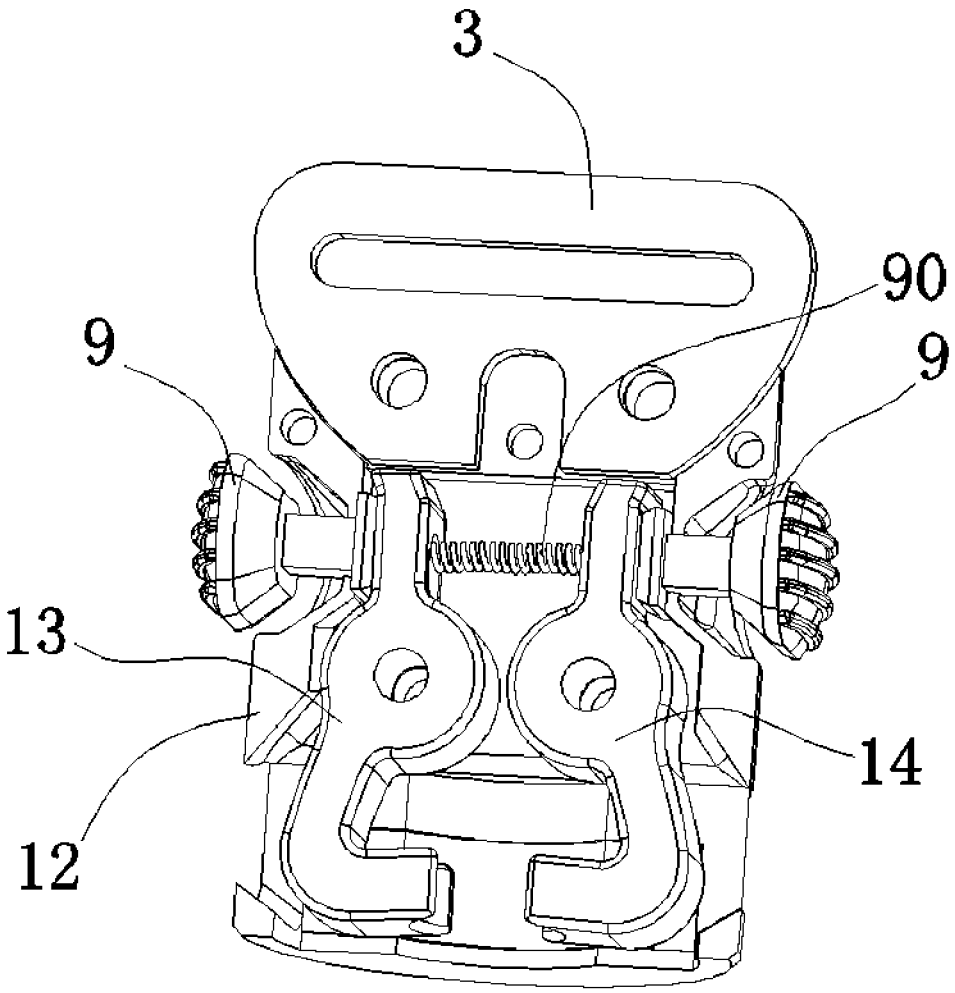
FIG. 13 is a structure view for the internal structure of the clamping head of FIG. 12.
Figure 14:
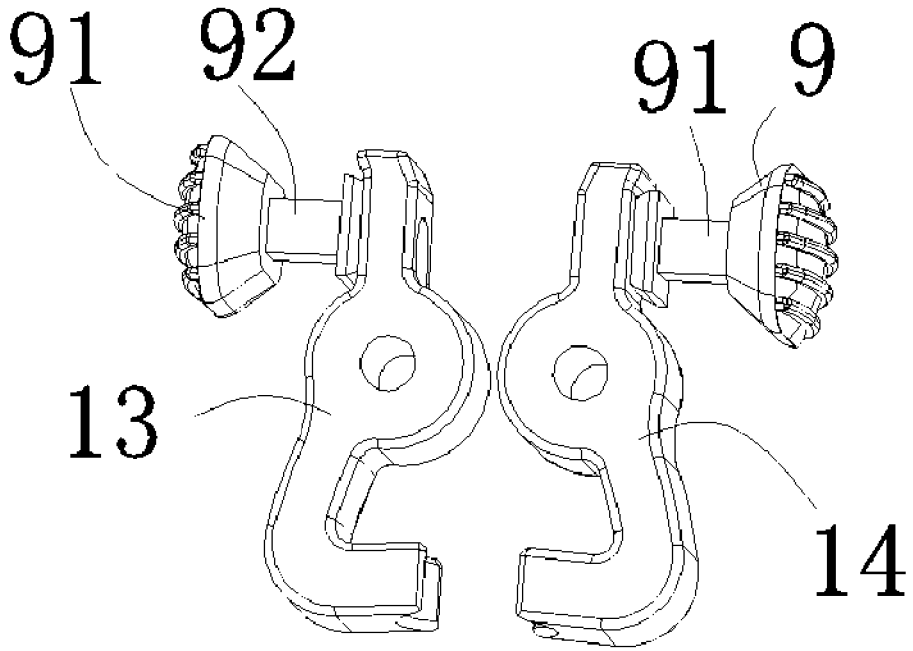
FIG. 14 is an internal structure view for the left fastener, the right fastener and the pressing member in FIG. 12.

As shown in FIG. 4 and FIG. 5, the said buckle subassembly comprises a left fastener 13 and a right fastener 14 which are symmetrically set in the cavity and have the same structure. The middle parts of the said left fastener 13 and right fastener 14 are hinged asway in the cavity. A pressure spring 90 is connected between the upper inner sides of the left fastener 13 and the right fastener 14, and the upper opposite sides of the left fastener 13 and the right fastener 14 are respectively set with a spring positioning hole 132. The two ends of the said pressure spring are respectively set in the spring location hole 132. The lower ends of the left fastener 13 and the right fastener 14 are oppositely set with a clamping block 131 matching with the said buckle head 21. A fastener unfolding device is connected to the upper ends of the left fastener 13 and the right fastener 14. The middle part of the left fastener 13 and the right fastener 14 is set with a hinge hole 134. The left fastener 13 and the right fastener 14 can swing by matching the hinge hole 134 and the screw. An acting force is applied to the fastener unfolding device to make the upper parts of the left fastener 13 and the right fastener 14 swing toward each other. The distance between the lower parts of the left fastener 13 and the right fastener 14 is increased, and the buckle head 21 is not covered by the clamping block 131. An acting force is applied to the clamping head 1 and the buckle base 2. When the acting force is greater than the magnetic attraction force between the magnetic subassemblies, the buckle head 21 and the buckle base can be separated.

The magnetic subassembly of the said clamping head 1 is set at a lower end of the said cavity, and the lower part of the said buckle subassembly is located at the magnetic subassembly of the clamping head 1. The magnetic subassembly of the said buckle base 2 is set in the said buckle base 2, and the magnetic subassembly of the said buckle base 2 is located under the said buckle head 21. The magnetic subassembly of the said buckle base 2 is a magnetic ring 29, and the magnetic ring 29 is fixed in the buckle base 2. When the magnetic subassemblies of the clamping head 1 and the buckle base 2 are mutually attracted, the buckle head 21 can be automatically inserted between the two clamping blocks 131. A pressure spring is connected between the upper inner sides of the left fastener 13 and the right fastener 14 to make the two clamping blocks 131 tighten the buckle head 21.

The said clamping head housing includes a front housing 11 and a rear housing 12, and the opposite walls of the front housing 11 and the rear housing 12 are respectively set with a half recess 16 forming the said cavity.

Figure 15:
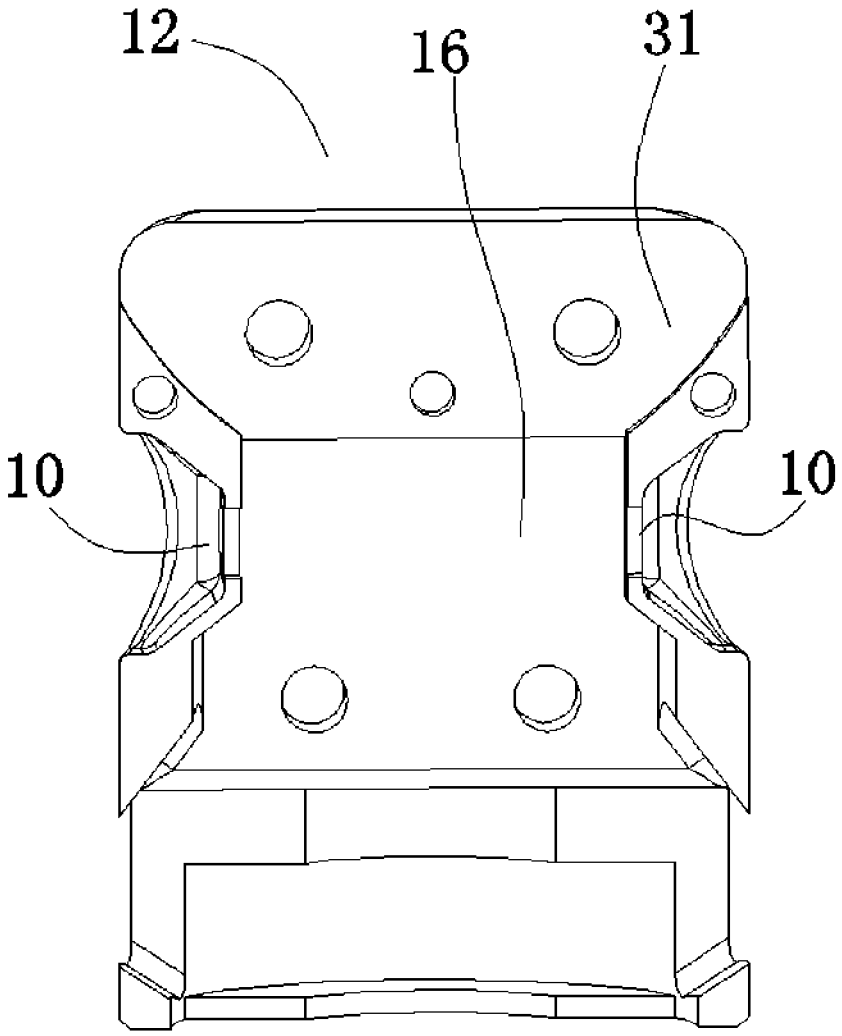
FIG. 15 is a structure view for the rear housing of FIG. 12.

A metal piece 3 is further fixed between the upper ends of the front housing 11 and the rear housing 12. The upper opposite walls of the front housing 11 and the rear housing 12 are respectively set with a locating slot of the metal piece 31 (see FIG. 15). The upper end of the metal piece 3 is set with a pull ring 31 stretching out the top of the front housing 11 and the rear housing 12. The lower end of the metal piece 3 is set with two pin holes 32, two pin shafts 4 are connected between the front housing 11 and the rear housing 12. The two pin holes 32 of the said metal piece 3 are covered with the said pin shafts 4 to fix the metal piece 3 with the front housing 11 and the rear housing 12. During use, the belt 5 and the clamping head housing can be connected when the belt 5 passes through the pull ring 31 and is tightened.

In other embodiments, several tapered protrusions for fixing belts are set at the upper ends of the opposite walls of the front housing 11 and the rear housing 12. During assembly, one end of the belt is placed between the front housing 11 and the rear housing 12. When the front housing 11 and the rear housing 12 are fixedly connected, the tapered protrusion presses the said belt to fix the belt at the upper end of the clamping head housing.

The magnetic subassembly of the clamping head 1 includes a front magnetic block and a rear magnetic block 121 (the front magnetic block and rear magnetic block 121 are not indicated in the figure). The front magnetic block and the rear magnetic block 121 are respectively fixed at the lower end of the recess 16 of the front housing 11 and the rear housing 12. As shown in FIG. 5, the rear magnetic block 121 is fixed in the fixed slot at the lower end of the recess 16 of the rear housing 12, and the front magnetic block is fixed in the fixed slot at the lower end of the recess 16 of the front housing 11.

As shown in FIG. 4, the said fastener unfolding device is a rope 19, and the two ends of the said rope 19 are respectively fixed with the upper ends of the left fastener 13 and the right fastener 14. The upper ends of the left fastener 13 and the right fastener 14 are set with the rope fixing holes 133, and two ends of the said rope 19 are respectively fixed in the rope fixing holes 133 of the left fastener 13 and the right fastener 14. The middle part of the rope 19 passes through the clamping head housing from the top of the said cavity. When the buckle base 2 is separated from the clamping head 1, the rope 19 shall be pulled to make the upper ends of the left fastener 13 and the right fastener 14 swing toward each other. The distance between the clamping blocks 131 is increased, and the buckle head 21 can be pulled out.

The said clamping block is laterally set, and the end of the buckle block 131 is set with a triangular or semi-circular notch 1311. The said buckle head 21 is a mushroom-shaped protrusion matching with the said clamping block 131. The mushroom-shaped protrusion is like a mushroom and comprises a lower cylinder 211 and an upper clamping body 212. The diameter of the clamping body 212 is greater than the diameter of the cylinder 211. The buckle base 2 is set with nuts. The said cylinder 211 is connected with nuts. The said two clamping blocks 131 are clamped on the cylinder 211, and the two clamping blocks 131 are located under the clamping body 212.

The said buckle base 2 has a plate shape, and the two ends of the buckle base are respectively set with long-striped webbing slots 22. The two long-striped slots 22 are respectively set in parallel. During use, another belt passes through the two long-striped webbing slots 22 to firmly and stably connect between the buckle base 2 and the belt.

In other embodiments, the said buckle base 2 may also be in a rectangular groove shape, the bottom of the buckle base is set with a rectangular groove-shaped webbing slot 22, and the long-striped webbing slot 22 is set in parallel. During use, another belt passes through the two long-striped webbing slots 22 to firmly and stably connect the buckle base and the belt.

The upper surface of the buckle base 2 is set with a circular groove 23, the inner diameter of the said circular groove 23 is greater than the outer peripheral diameter of the clamping head housing, and the said buckle head 21 is located in the middle of the said circular groove 23. The middle of the said circular groove 23 is further set with a receiving groove of magnetic ring 28. The said magnetic ring 29 is placed in the receiving groove of magnetic ring 28, and its position is limited by the cover plate 27 at the top of the receiving groove of magnetic ring 28. The circular groove 23 can prevent the joint between the clamping head 1 and the buckle base 2 from being impacted by an external force and make the connection firm and stable.

The opposite walls of the front housing 11 and the rear housing 12 are set with matching positioning columns 17 and positioning holes, and the front housing 11 and the rear housing 12 are matched and connected with screws and nuts. Thus, the connection between the front housing 11 and the rear housing 12 is firm and stable without misplacement.

A method of using an automatic magnetic buckle includes the following steps:

Step 1: The buckle base 2 is close to the clamping head 1, and the buckle base 2 is mutually attracted with the magnetic subassembly on the clamping head 1. Under the action of the magnetic attraction force, the buckle head 21 is inserted into the cavity of the clamping head housing, the buckle subassembly is used to fix the buckle head 21, and the clamping head 1 is fixedly connected with the buckle base 2.

In Step 1, the magnetic force of the magnetic subassembly on the buckle base 2 and the clamping head 1 has the buckle base 2 and the clamping head 1 attached together. At this moment, the lower end of the clamping head is located in the said circular groove 23. The buckle head 21 is inserted between the two clamping blocks 131, and the clamping body 212 of the clamping head 21 is located above the clamping block 131. Due to the action of the pressure spring, the cylinder 211 of the two clamping blocks 131. The matching of the buckle head 21 and the clamping block 131 makes the connection between the buckle base 2 and the clamping head 1 stable and firm.

Step 2: An acting force is applied to the left fastener 13 and the right fastener 14 via the fastener unfolding device to make the upper ends of the left fastener 13 and the right fastener 14 swing toward each other. The distance between the two clamping blocks 131 is increased, and the buckle head 21 can be removed from the clamping head 1 to separate the clamping head 1 and the buckle base 2.

In Step 2, the rope 19 is pulled up to make the upper ends of the left fastener 13 and the right fastener 14 swing toward each other. The distance between the two clamping blocks 131 is increased. When the distance between the two clamping blocks 131 is greater than the diameter of the clamping body 212, the buckle head 21 can be pull out from the clamping head 1.

During use, a rope passes through the two long strip-shaped grooves 22 and fixedly connects with people, animals or other objects which need to be towed. The upper end of the clamping head housing is fixedly connected with the tow rope to conveniently fix and connect the tow rope to people, animals or other objects which need to be towed. They can be separated very easily.

The structural design of the present invention is reasonable and ingenious. The fixed connection between the buckle base 2 and the clamping head 1 can be easily realized by the action of the magnetic subassembly, and the connection is stable and firm. The buckle base 2 and the clamping head 1 can be conveniently separated by the design of the fastener unfolding device. Moreover, the buckle base and the clamping head can rotate at 360°, so the buckle base and the clamping head can be buckled or separated at any angle. It can be operated conveniently and saves time and effort.

Refer to FIG. 5 to FIG. 10 for Embodiment 2. The present embodiment is substantially the same as Embodiment 1, but their differences are as follows:

The said buckle base 2 is cylindrical, the lower part of the buckle base 2 is set with a metal piece 210, and the metal piece 210 is set with a long-striped webbing slot 22.

The upper surface of the buckle base 2 is set with a circular groove 23, the inner diameter of the said circular groove 23 is greater than the outer peripheral diameter of the clamping head housing, and the said buckle head 21 is located in the middle of the said circular groove 23. The middle of the said buckle base 2 is further set with a receiving groove of magnetic ring 28. The said buckle head 21 is a mushroom-shaped protrusion matching with the said clamping block 131. The mushroom-shaped protrusion is like a mushroom and comprises a lower cylinder 211 and an upper clamping body 212. The diameter of the clamping body 212 is greater than the diameter of the cylinder 211. The buckle base 2 is set with nuts. The said cylinder 211 is connected with nuts.

Refer to FIG. 12 to FIG. 15 for Embodiment 3. The present embodiment is substantially the same as Embodiments 1 and 2, but their differences are as follows: the said fastener unfolding device has two pressing members 9, and the said pressing members include a pressing rod 91 and a pressing head 92 which are interconnected. The pressing rods 91 of the two pressing members 9 are respectively in contact with the outer sides of the left fastener 13 and the right fastener 14, and the said pressing head 92 stretches out the outer periphery of the clamping head housing.

The said clamping head housing includes a front housing 11 and a rear housing 12, and the opposite walls of the front housing 11 and the rear housing 12 are respectively set with a half recess 16 forming the said cavity.

The opposite walls of the front housing 11 and the rear housing 12 are respectively relative to the pressing rod 91 and the pressing head 92, forming a holding tank 10.

The above is only a preferred embodiment of the present invention and is not intended to limit the present invention in any way. Any technician who is familiar with the present field can make many possible changes and modifications for the technical solution of the present invention by the above disclosed technical means and technical content, or modify them as equivalent embodiments with the same changes. Any contents without going beyond the scope of the technical solutions of the present invention shall be covered in the protective scope of the present invention according to equivalent changes in the shape, structure and principle of the present invention.

What is claimed is:

1. An automatic magnetic buckle, comprising a clamping head and a buckle base matching with each other, wherein the clamping head comprises a clamping head housing, and the clamping head housing has a cavity extending through upper and lower ends of the clamping head housing; the cavity is configured with a buckle subassembly, and the buckle base is configured with a buckle head matching with the buckle subassembly, and the clamping head and the buckle base are configured with magnetic subassemblies respectively which are mutually attracted: the buckle subassembly comprises a left fastener and a right fastener which are symmetrically configured in the cavity; middle parts of the left fastener and right fastener are hinged in the cavity: a pressure spring is connected between upper inner sides of the left fastener and the right fastener, and opposing clamping blocks are configured at lower ends of the left fastener and the right fastener respectively: the clamping blocks match with the buckle head; a fastener unfolding device is connected to upper ends of the left fastener and the right fastener.

2. The automatic magnetic buckle, of claim 1, wherein the magnetic subassembly of the clamping head is configured at a lower end of the cavity, and a lower part of the buckle subassembly is located at the magnetic subassembly of the clamping head; the magnetic subassembly of the buckle base is configured in the buckle base, and the magnetic subassembly of the buckle base is located under the buckle head.

3. The automatic magnetic buckle of claim 2, wherein the buckle base has a plate shape, and two ends of the buckle base are configured with long-striped webbing slots respectively: the long-striped webbing slots are configured in parallel;

an upper surface of the buckle base is configured with a circular groove, an inner diameter of the circular groove is greater than an outer peripheral diameter of the clamping head housing, and the buckle head is located in the middle of the circular groove.

4. The automatic magnetic buckle of claim 2, wherein the buckle base is cylindrical, a lower part of the buckle base is configured with a metal piece, and the metal piece is configured with a long-striped webbing slot;

an upper surface of the buckle base is configured with a circular groove, an inner diameter of the circular groove is greater than an outer peripheral diameter of the clamping head housing, and the buckle head is located in the middle of the circular groove.

5. The automatic magnetic buckle of claim 2, wherein the buckle base has a rectangular groove shape, a bottom of the buckle base is configured with a rectangular groove-shaped webbing slot.

6. The automatic magnetic buckle, according to claim 1, wherein the clamping head housing includes a front housing and a rear housing, and opposite walls of the front housing and the rear housing are respectively configured with a half recess forming the cavity;

a metal piece is further fixed between upper ends of the front housing and the rear housing, and an upper end of the metal piece is configured with a pull ring extending out from top sides of the front housing and the rear housing.

7. The automatic magnetic buckle of claim 6, wherein the opposite walls of the front housing and the rear housing are configured with matching positioning columns and positioning holes, and the front housing and the rear housing are matched and connected with screws and nuts.

8. The automatic magnetic buckle, of claim 1, wherein the fastener unfolding device is a rope, and two ends of the rope are respectively fixed with the upper ends of the left fastener and the right fastener; a middle part of the rope passes through the clamping head housing from a top side of the cavity.

9. The automatic magnetic buckle, of claim 1, wherein the fastener unfolding device has two pressing members, and each of the pressing members include a pressing rod and a pressing head which are interconnected; the pressing rods of the two pressing members are respectively in contact with outer sides of the left fastener and the right fastener, and the pressing head of each pressing member extends out of an outer periphery of the clamping head housing.

10. The automatic magnetic buckle, of claim 1, wherein the clamping blocks are laterally configured, and an end of each of the clamping blocks is configured with a triangular or semi-circular notch; the buckle head is a mushroom-shaped protrusion matching with the clamping blocks.

* * * * *